US009857130B2

(12) United States Patent
Purkiss

(10) Patent No.: US 9,857,130 B2
(45) Date of Patent: Jan. 2, 2018

(54) PROTECTIVE MAGAZINE CARRIER WITH FINGER GRIPS

(71) Applicant: Joshua Purkiss, Chicago, IL (US)

(72) Inventor: Joshua Purkiss, Chicago, IL (US)

( * ) Notice: Subject to any disclaimer, the term of this patent is extended or adjusted under 35 U.S.C. 154(b) by 0 days.

(21) Appl. No.: 14/831,810

(22) Filed: Aug. 20, 2015

(65) Prior Publication Data

US 2017/0051990 A1 Feb. 23, 2017

(51) Int. Cl.
*F42B 39/02* (2006.01)
*F41A 9/61* (2006.01)

(52) U.S. Cl.
CPC ..... *F41A 9/61* (2013.01)

(58) Field of Classification Search
CPC ..... F41A 9/68; F41A 9/63; F42B 39/02
USPC ..... 224/931, 245, 239, 674; 42/90
See application file for complete search history.

(56) References Cited

U.S. PATENT DOCUMENTS 1,756,677 A * 4/1930 Cook ..... F42B 39/02 206/3
3,066,791 A * 12/1962 Bivens ..... F42B 39/02 206/3
4,467,947 A * 8/1984 Minneman ..... F42B 39/02 206/3
4,484,403 A * 11/1984 Schwaller ..... B65D 21/0204 42/50
4,799,323 A * 1/1989 Musgrave ..... F42B 39/02 42/90
5,152,442 A * 10/1992 Gallagher ..... A45F 5/02 206/3
6,202,908 B1 * 3/2001 Groover ..... F42B 39/02 224/236
6,212,815 B1 * 4/2001 Fitzpatrick ..... F41A 9/65 224/196
6,481,136 B1 * 11/2002 Fitzpartick ..... F41A 9/65 42/18
6,698,129 B1 * 3/2004 Hanks ..... F41A 9/63 42/90
8,104,656 B1 * 1/2012 George ..... A45F 5/021 224/239
8,322,065 B2 * 12/2012 Faifer ..... F41A 9/63 206/3
8,793,914 B2 * 8/2014 Anderson ..... F41A 9/65 42/49.01
8,887,977 B2 * 11/2014 Ralph ..... F42B 39/02 224/245
9,097,489 B2 * 8/2015 Chiang ..... F42B 39/02
9,354,006 B2 * 5/2016 Purkiss ..... F41A 9/68
2004/0200111 A1 * 10/2004 Horn ..... A45F 5/00 42/50

(Continued)

*Primary Examiner* — Michael David

(57) ABSTRACT

The magazine carrier has flexible yet durable material of construction and slides directly into a rifle magazine and is kept on the magazine during loading into a rifle. The carrier includes novel features for the modern operator including forward facing finger grips and a loop at the bottom to provide magazine drawing and storage options as well as impact protection to the magazine. In addition to providing direct protection to the magazine from contaminants such as dirt and mud, the magazine carrier can also be provided in an alternative embodiment with infrared signature reduction panels to provide the operator with an overall reduced infrared signature.

6 Claims, 6 Drawing Sheets

(56) References Cited

U.S. PATENT DOCUMENTS

| | | | | |
|---|---|---|---|---|
| 2007/0278269 | A1* | 12/2007 | Rogers | F41A 9/65<br>224/239 |
| 2012/0174452 | A1* | 7/2012 | Anderson | F41A 9/65<br>42/49.01 |
| 2016/0003567 | A1* | 1/2016 | Purkiss | F41A 9/68<br>42/49.01 |

* cited by examiner

PROTECTIVE MAGAZINE CARRIER WITH FINGER GRIPS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The present invention relates to magazine carriers for use with firearms, and more particularly to a magazine carrier that has several unique capabilities.

It is well known that the first rifle design to use a tubular magazine was the Volition Repeating Rifle, designed by inventor Walter Hunt in 1848. Magazine designs have since evolved beyond rifles to also include applications for pistols such as the modern AR-15 pistol. Modern firearm magazines are now available to hold ammunition in several configurations and basic shapes. Examples of configurations in the prior art include single column, staggered (double stack) and quad column. Examples of shape evolution in magazine housings include straight (linear), curved (arc), rotary magazines, drum magazines and even helical magazines. However, regardless of the magazines of prior art, ammunition capacity or ability to feed into a firearm, the basic design itself has several notable deficiencies which will next be discussed.

A common risk typically faced by both military and police officers while preparing to enter a hostile area (for example, a police raid on a drug dealer's residence, foot chases with decreased lighting conditions, or search and acquire target missions where noise discipline is imperative) is the risk of being detected by a target too early before the room is breached. Premature detection by an armed and dangerous subject gives the subject additional time to dedicate to his decision making process, and further negates the operator's ability to surprise, shock, and secure the subject. The rifles of prior art have essentially no noise suppression in these close combat situations, and the magazine itself due to its position on the rifle and metallic materials of construction certainly contribute to the risk of a failed sound discipline strategy.

Another drawback seen with mainly military units is the increased availability to enemy combatants of technologies once kept within the armed forces such as thermal (IR) or related other night vision technologies. Indeed, with such systems, the operator's previous advantages of night raids have been substantially reduced in value. An additional drawback to prior art magazines is that magazines in general have small seams which can allow contaminants such as dirt and related debris to enter. Over time, if not rectified by regular cleaning and maintenance, the magazine may malfunction.

Yet another drawback of magazines of prior art is that being made of smooth metal, they have the potential to slip when being fired as they offer no ergonomic features such as finger grips, and are less than optimal when encountering the lubricating effect of human sweat on metal. Because of this many shooters wear special shooter gloves that have friction enhancements such as rubber grips. Although this can be effective, if these gloves are forgotten or misplaced during an operation, the operator will be at a substantial disadvantage. The final drawback to magazines of prior art is that they require the professional shooter to use tactical vests to carry extra ammunition. These vests typically store magazines by using bulky tubular pockets sewn into the vest to carry individual magazines. Because the magazines are metallic and smooth and these vests are made with different degrees of snugness to prevent magazines from falling out, some users have complained that it takes too long to draw a fully loaded magazine during a tactical combat situation.

A thorough survey of existing magazine carrier patents does not reveal any prior art magazine carriers that have any of the unique capabilities of the present invention. For example, U.S. Pat. No. 8,887,977 entitled Magazine Carrier and issued to Ralph discloses a boxlike magazine carrier that has a side clip suitable for attachment to articles of clothing. U.S. Pat. No. 8,322,065 also entitled Magazine Carrier and issued to Faifer discloses a similar boxlike carrier that also has side clips of a slightly different design also for attachment to the uniform of the firearm user. U.S. Pat. No. 8,104,656 entitled Spare ammunition magazine carrier with pivotable flap and issued to George discloses a magazine carrier that has a pivotable flap to expose the top of a magazine inserted into the carrier and designed to be worn on a belt as part of a uniform. U.S. Pat. No. 6,202,908 entitled Spare magazine carrier with retractable flap issued to Groover discloses yet another boxlike magazine carrier designed for wearing on the belt but instead having a flap that can be retracted downwards to allow access to the stored magazine. Finally, U.S. Pat. No. 4,799,323 entitled Magazine carrier for use on firearms or other support and issued to Musgrave discloses a magazine carrier with a spring loaded mechanism for keeping a magazine securely stored while allowing removal with only one hand.

To this end, there exists the need for a magazine carrier that can accommodate the needs of not only the modern day police officer and soldier, but also for more advanced users, to include those in the special operations community. It is the object of the present invention to address the modern user needs by providing truly unique capabilities, and shooting experience, that go beyond just the capability to carry magazines by providing additional features which shall be discussed presently.

BRIEF SUMMARY OF THE INVENTION

It is a first object of the present invention to provide a magazine carrier that can provide a barrier of protection from contaminants such as dirt, sand and other performance degrading contaminants in outdoor environments.

It is yet another object of the present invention to provide a magazine carrier that includes forward facing finger grips to provide increased grip and ergonomic advantages for the shooter.

It is yet another object of the present invention to provide a magazine carrier that includes a hexagonal shaped loop for additional impact protection as well as faster magazine drawing options when using ammunition carrying vests.

It is yet another object of the present invention to provide a magazine carrier that is built of rubber related compounds to offer increased noise discipline by providing a protective non-metallic barrier around the magazine to prevent noises such as taps or clanging against other hard surfaces.

It is yet another object of the present invention to provide a magazine carrier that has an option to include materials that can reduce the infrared (IR) signature from the magazine itself when a magazine carrier is used by the shooter, thereby lowering the overall IR signature.

DETAILED DESCRIPTION OF THE INVENTION

Figure 1:
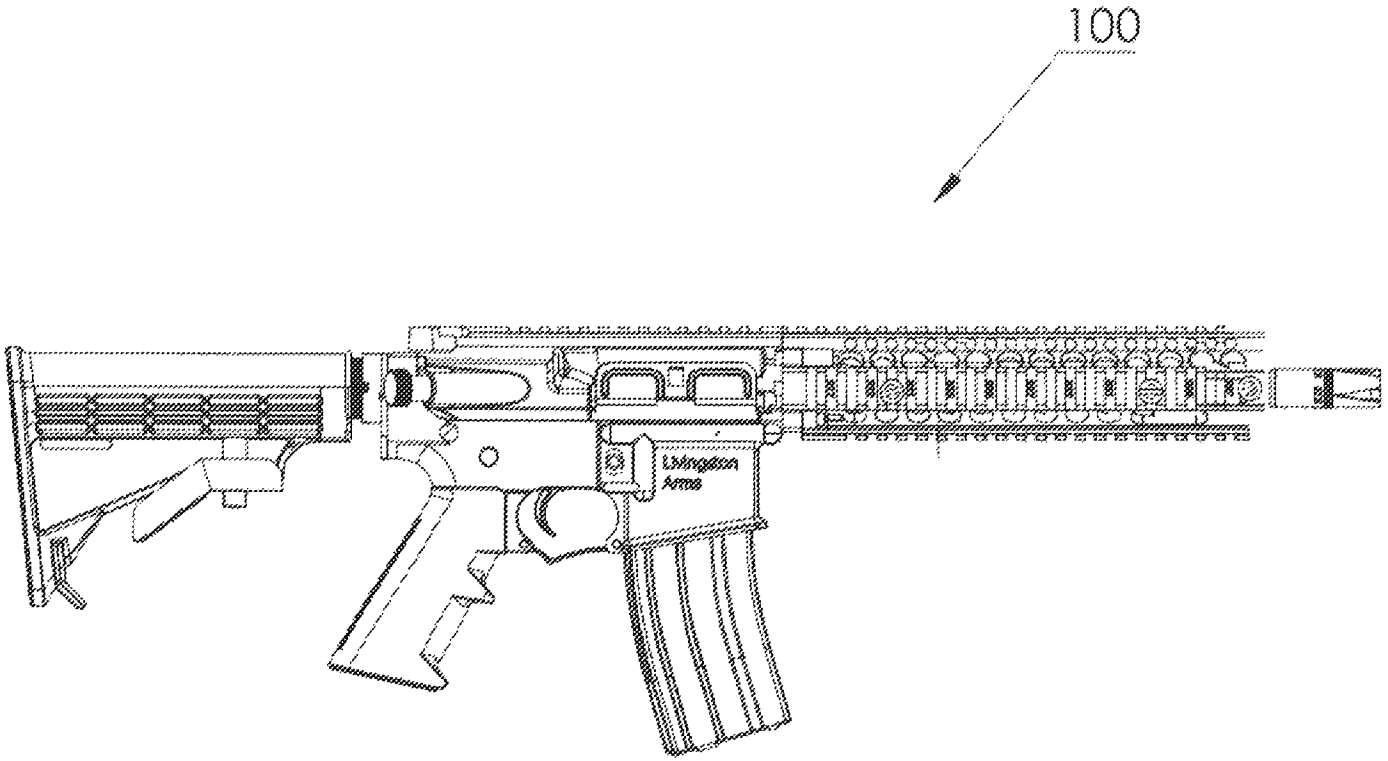
FIG. 1 is a perspective view of a commonly used rifle without a magazine carrier attached.

Referring now to the drawings and in particular FIG. 1, an example of a modern rifle that would be suitable for use with the magazine carrier of the present invention is generally designated by reference numeral 100. The example rifle shown in FIG. 1 is a version of the AR-15 rifle and is widely used by the United States armed forces. It should be obvious to one skilled in the art of magazine carriers that the present invention may also be used to fit magazines that carry other calibers of ammunition. The intended use of the magazine carrier of the present invention is to not only carry an actual ammunition magazine but is also further intended to be kept connected to the magazine itself during subsequent loading of the magazine into the rifle.

Figure 2:
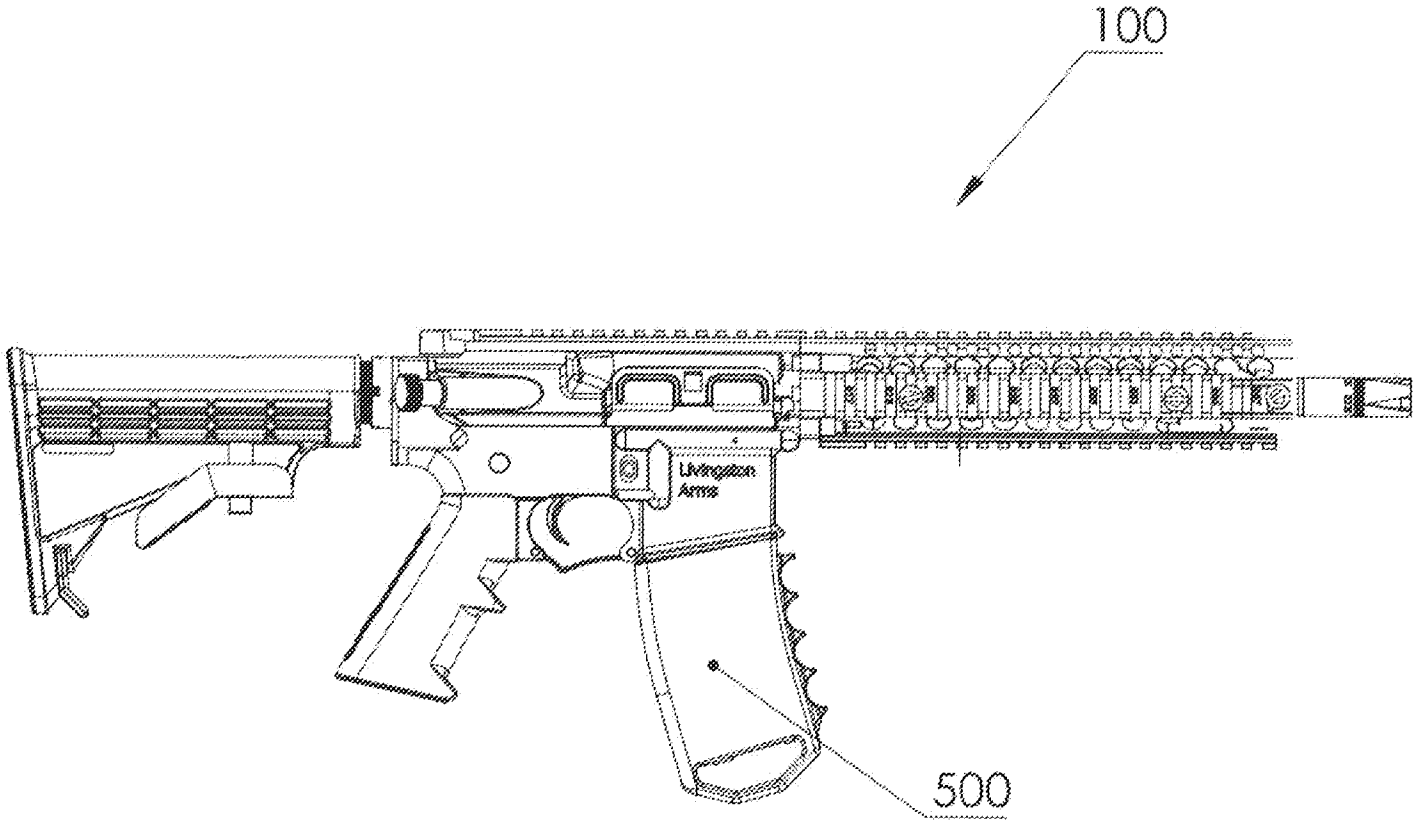
FIG. 2 is a perspective view of the rifle in FIG. 1 shown with the magazine carrier attached.
Figure 3:
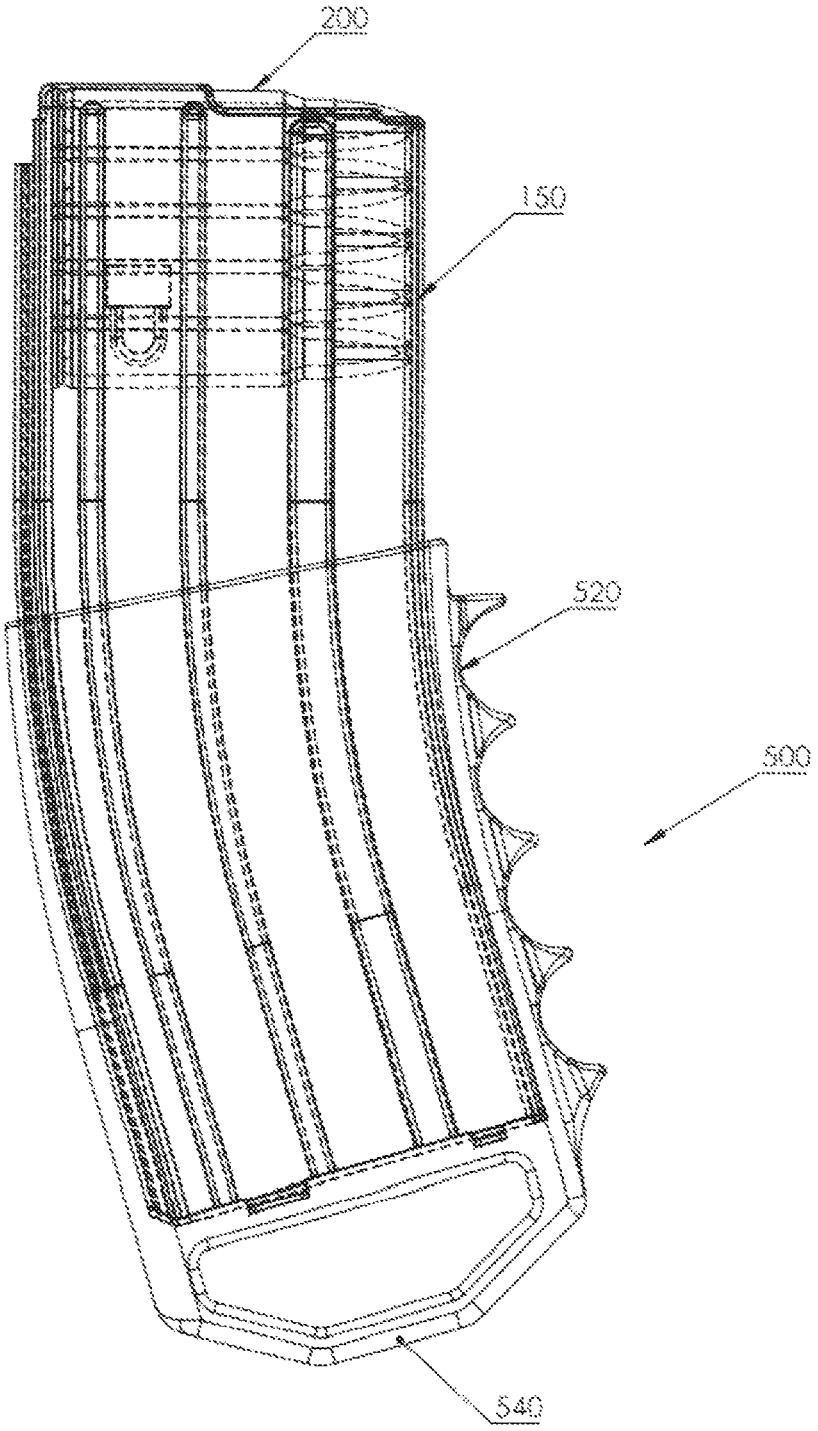
FIG. 3 is a detailed view of the magazine carrier of the present invention.

Referring next to FIGS. 2 and 3, the intended use of the magazine carrier of the present invention is shown with the magazine carrier 500 securely attached to the magazine 150 of rifle 100. For orientation purposes, magazine 150 is shown with several rounds of 5.56 mm ammunition 200 loaded into the magazine. Magazine carrier 500 is shown attached to the bottom half of magazine 150. The material of said magazine carrier 500, in the preferred embodiment, is made of a flexible yet high strength material suitable for use in the rugged outdoor environments of modern military and police operators. Examples of materials preferred for construction of said magazine carrier 500 include the category of TPUs (thermoplastic urethanes), rubbers and silicone based rubbers. These materials are well known to possess a respectable heat resistance, and can also be molded in a wide range of durometers that will provide a snug fit when the carrier is slid into the magazine.

Referring again to FIG. 3, magazine carrier 500 is designed to closely match the contours of various ammunition magazines so that no other securing mechanisms such as Velcro fasteners or tapes are required to join the two together. The inside walls of said magazine carrier 500 is designed with a tolerance to create a friction fit between the external walls of said magazine 150 and the inteernal walls of said magazine carrier 500. By having these features, the magaine carrier of the present invention can be easily remnoved from the magazine by hand, but still will not come loose from said magazine 150 during use by the operator.

Refrring again to FIG. 3, the magazine carrier 500 contains two external features which offer additional advantages to the operator. The first feature is forward facing finger grips 520. In the preferred embodiment, these grips are a molded directly into said magazine carrier 500 and are intended to give the operator the option to use said finger grips 520 for use in various shooting positions such as the three point shooter's platform. The operator that chooses to use said finger grips 520 will also have the advantages of decreased risk of slippage and finger cushioning which are not available with typical rifle magazines of prior art. The second feature is a loop 540 which forms an open pocket located at the bottom distal end of said magazine carrier 500. Although the shape of the loop 540 is shown as hexagonal in shape, it should be obvious to one skilled in the art of magazine carriers that other geometric shapes are also possible to create other shape loops 540 such as elliptical, circular arc or rectangular shapes. The primary purpose of said loop 540 of magazine carrier 500 are to provide additional impact protection for the rifle magazine 150 as well as options for the operator to use for drawing the magazine and hanging the magazine onto articles of clothing such as tactical vests.

Referring again to FIG. 3, said loop 540 of magazine carrier 500 could be used in one embodiment to safely stack multiple carrier magazines together using a typical holding device such as a rod. In another embodiment, said loop 540 of magazine carrier 500 can be used to provide a finger grip area to more quickly extract said magazine 150 from a tactical vest by using only one hand of the operator. The potential time saved by allowing a faster drawing and insertion of a fully loaded magazine using said loop 540 of carrier 500 will greatly assist the modern military and police operator by providing him with precious extra time in a high stress, hostile shooting envionment.

Figure 4:
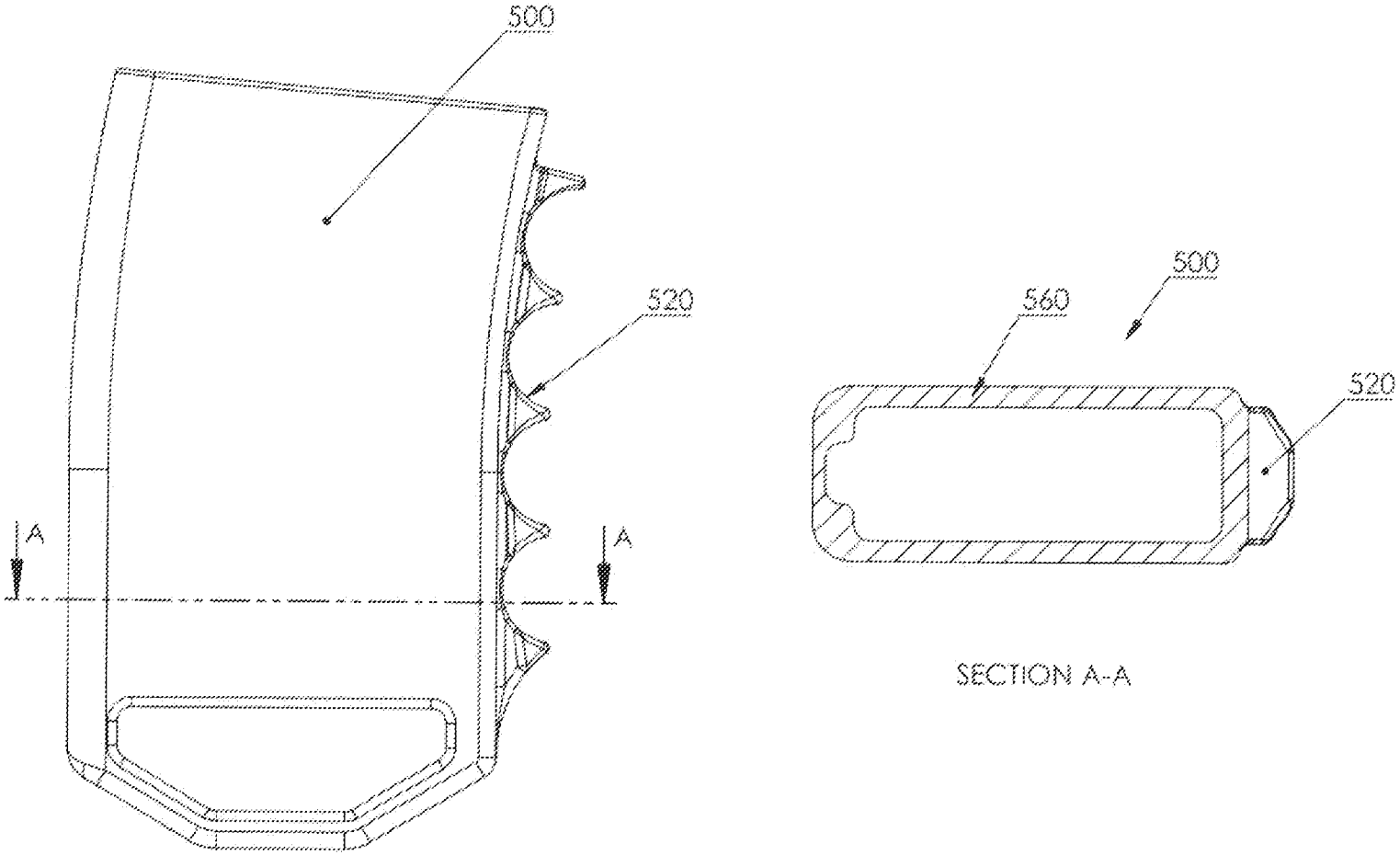
FIG. 4 is a cross sectional view of the magazine carrier shown as the primary embodiment and made of a single homogenous material.

Referring next to FIG. 4, the primary embodiment of said magazine carrier 500 of the present invention shall next be discussed. In the preferred embodiment, the entire magazine carrier is constructed of a single material that has a good degree of stiffness, high tensile and compressive strength and is suitable for mass production methods such as injection molding. This material of construction is denoted by 560 and in FIG. 4 is shown in cross sectional view to show the thickness of the walls of said carrier 500. In the preferred embodiment, this material will come from either the family of thermoplastic urethanes (TPUs), high density polyethylenes (HDPE) or silicone based rubbers. In this preferred primary embodiment, manufacturing costs are low because there are no secondary manufacturing operations required. Items such as logos and model names and numbers may be molded directly into the carrier without the need to apply external labelled parts.

Figure 5:
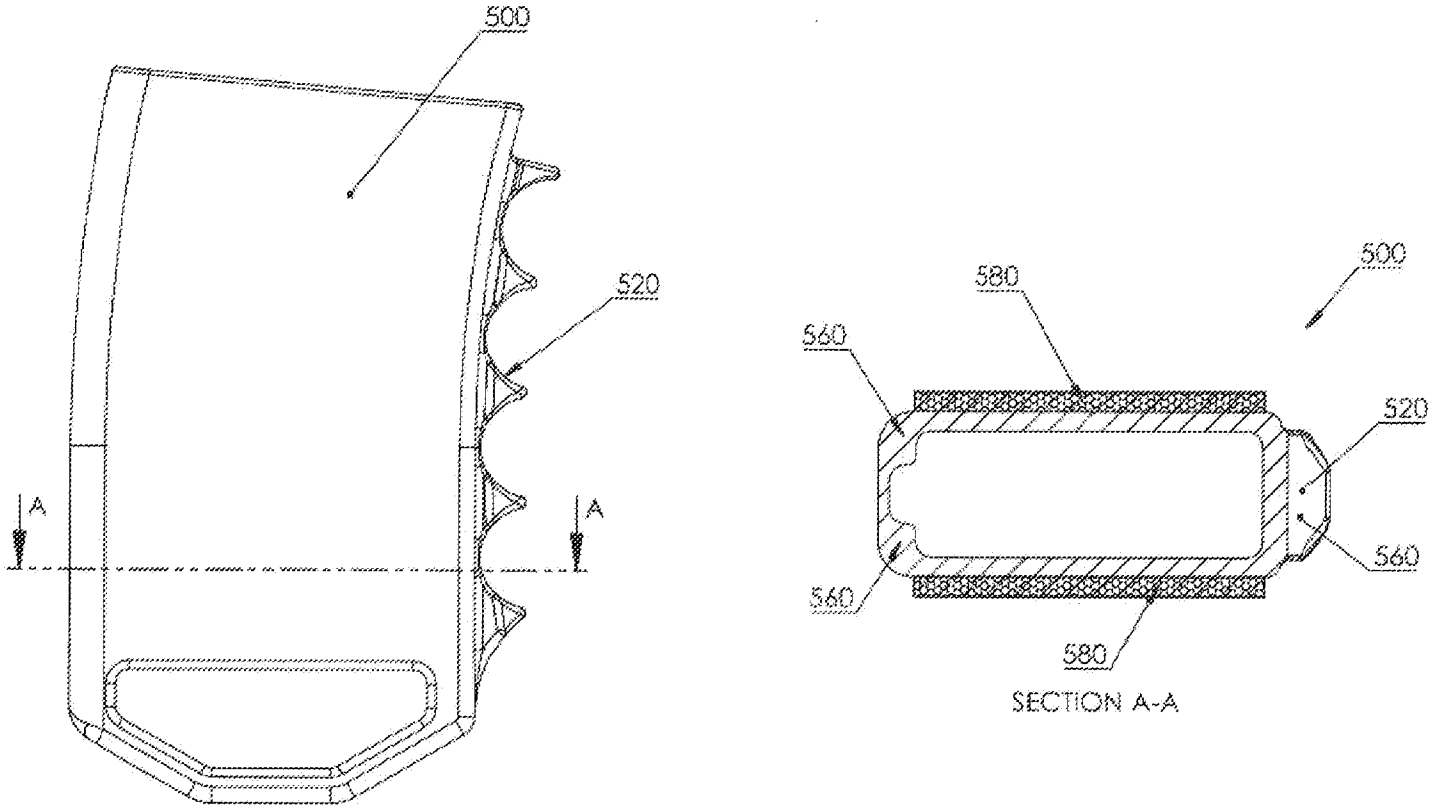
FIG. 5 is a cross sectional view of the magazine carrier shown as a secondary embodiment that has exterior panels attached, said panels having a special coating to reduce the infrared signature of the magazine carrier itself.

Referring next to FIG. 5, an alternative embodiment of the magazine carrier 500 of the present invention shall next be discussed. In this embodiment, there is a second material of construction used to provide the magazine carrier with the optional capability to reduce the infrared signature of the magazine carrier itself. In this alternative embodiment, this second material of construction is denoted by 580 in FIG. 5. and is represented in the cross sectional view as two panels 580 that are rigidly attached on opposite sides of said carrier

500. By using special coatings available now that absorb infrared wavelengths, these panels when viewed by thermal scopes for example will appear to blend in with the surrounding environment, providing additional concealment to the operator. In a preferred embodiment, said IR reduction panels 580 would preferably be manufactured by spraying, dipping or painting onto these panels proprietary IR absorbing compounds known to have high IR absorption properties. One example supplier of proprietary IR absorbing compounds from prior art is Epolin of Newark, N.J.

Figure 6:
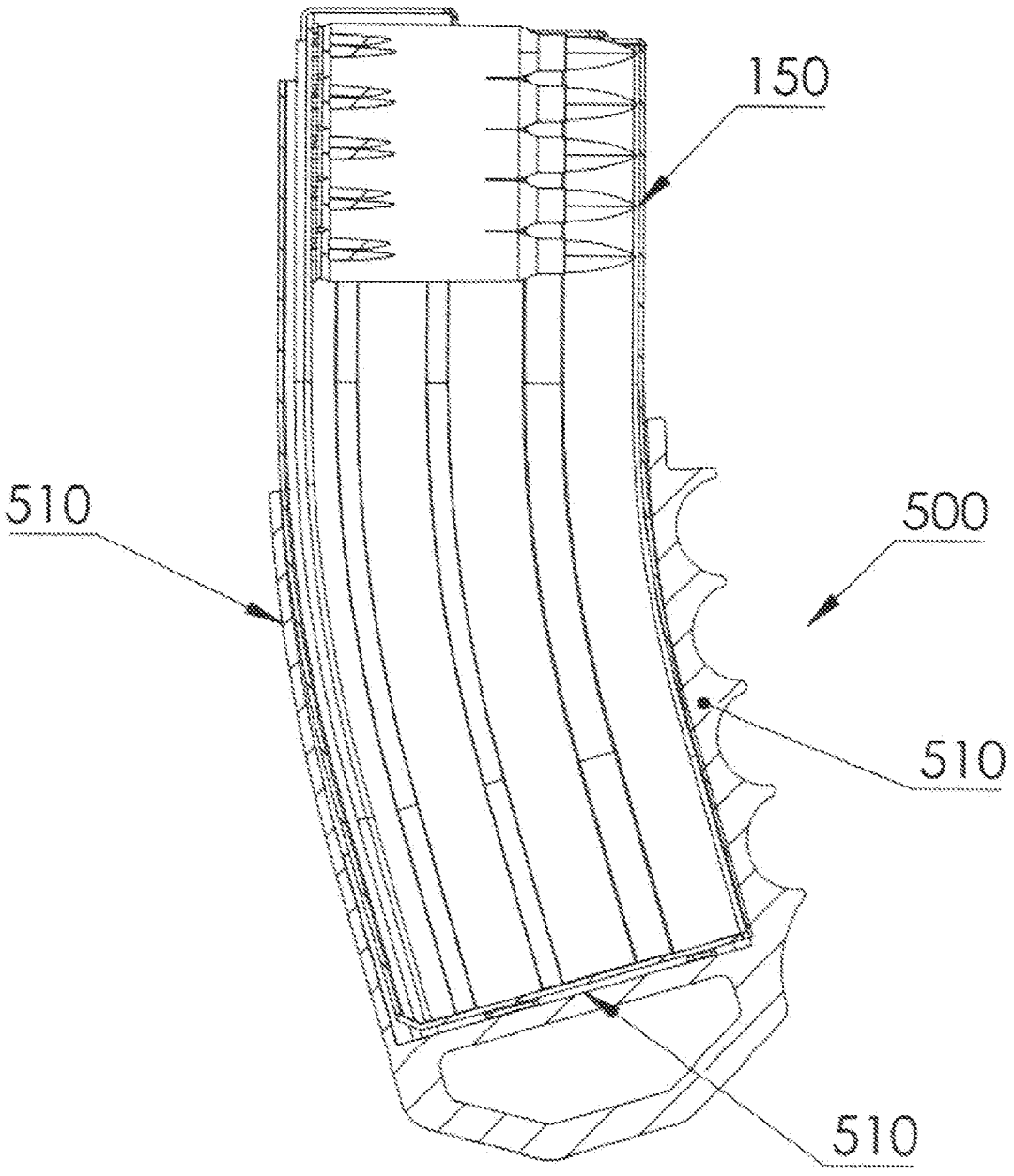
FIG. 6 is a cross sectional view of the magazine carrier to show how the walls of the magazine carrier create a protective barrier against contaminants such as dirt, sand and related debris from entering the magazine.

Referring next to FIG. 6, another important feature of said magazine carrier 500 of the present invention shall be discussed. In this preferred embodiment, the magazine carrier 500 provides an effective barrier against contaminants entering said magazine 150 by covering exposed seams of said magazine 150. As seen in cross section, the entire bottom half of said magazine 150 is protected at the front, left and right sides and the bottom faces of said magazine 150 from exposure to dirt and other harmful contaminants. The walls 510 of carrier 500 are made of non-porous materials that also do not absorb moistue, so said carrier 500 is also an effective barrier against damage from liquid contaminants such as dirty water or mud.

Referring again to FIGS. 1, 2 and 6, the final feature of increased noise discipline of said magaine carrier 500 shall be discussed. Referring back first to FIG. 1, the rifle of prior art 100 has many exterior metal surfaces which will produe significant noise if they are struck against other surfaces during transport to the intended location by the operator. One example of noise might be the magazine tapping against a metal flashlight or against a spare magazine carried by the operator or fellow team member. In contrast, the rifle shown in FIG. 2 provides some additional noise discipline by covering over the exposed metal portion of the magazine with a softer material such as a rubber or a similarly soft thermoplastic compound. In the same example, this would have provided the operator using the rifle and carrier combination shown in FIG. 2 with a quieter approach. This increased noise discipline provided by carrier 500 will therefore give the tactical police or military operator an extra advantage against early detection by a pursued target. As shown in FIG. 6, said walls 510 are molded of a homogenous and softer than metal material, and when struck by a hard surface such as a flashlight or metallic item carried on a vest or belt will not produce as loud of a sound and therefore should increase the chance that the police or military operator may approach a target, or target's residence in a safer manner by preventing premature detection.

SEQUENCE LISTING

Not Applicable

What is claimed is:

1. A magazine carrier for use with a 5.56 30 round ammunition magazine, the magazine carrier comprising:

a frame having walls shaped to closely conform to the exterior surfaces of a 5.56 30 round magazine;

said frame having an open top shaped to receive said 5.56 30 round magazine;

said frame including four finger grip protrusions running along a front wall;

said frame including a reversibly collapsible six sided handle located at a bottom end of said frame;

said reversibly collapsible six sided handle having a rectangular shaped upper portion consisting of three sides and a trapezoidal shaped lower portion consisting of three additional sides;

said rectangular shaped upper portion of said collapsible six sided handle having a first longer side having a length of approximately 2.1 inches, the second and third sides being perpendicular to said first side and each having a length of approximately 0.34 inch;

a set of two detachable panels which substantially cover two side walls of said frame, said detachable panels comprising a metallic alloy coated with a material having low thermal emissivity; and said trapezoidal shaped lower portion of said collapsible six sided handle having a first longer side having a length of approximately 0.81 inch and centered with and parallel to said first longer side of said rectangular upper portion, the second and third sides each having a length of approximately 0.64 inch and each forming an angle of approximately thirty degrees with said first longer side of said upper rectangular shaped portion of said collapsible six sided handle.

2. The magazine carrier of claim 1, wherein the material from which the carrier is manufactured is selected from the group of synthetic rubbers such as styrene butadiene rubber (SBR).

3. The magazine carrier of claim 1, wherein the overall length between the open top and a bottom side of said six sided collapsible handle is approximately 5 inches.

4. The magazine carrier of claim 1, wherein the overall outside width between the side walls is approximately 1.13 inches.

5. The magazine carrier of claim 1, wherein a wall thickness of said six sided reversibly collapsible handle is approximately 0.24 inch.

6. The magazine carrier of claim 1, wherein said reversibly collapsible six sided handle will collapse and conform to the shape of the object to which it is pressed against during use in order to help anchor and stabilize the rifle when firing, and will then return to its original shape when not pressed against the object.

* * * * *